US007768411B2

(12) United States Patent
Celauro

(10) Patent No.: US 7,768,411 B2
(45) Date of Patent: Aug. 3, 2010

(54) TOTAL TEMPERATURE INFORMATION MANAGEMENT FOR COMMERCIAL AIRLINERS APPARATUS AND METHOD THEREFOR

(76) Inventor: Paul J. Celauro, 6 Water Track Radial, Ocala, FL (US) 34472

( * ) Notice: Subject to any disclaimer, the term of this patent is extended or adjusted under 35 U.S.C. 154(b) by 401 days.

(21) Appl. No.: 11/977,815

(22) Filed: Oct. 26, 2007

(65) Prior Publication Data

US 2008/0150735 A1 Jun. 26, 2008

Related U.S. Application Data

(60) Provisional application No. 60/854,484, filed on Oct. 26, 2006.

(51) Int. Cl.
*G08B 17/00* (2006.01)
*G08B 21/00* (2006.01)

(52) U.S. Cl. ..... 340/584; 340/945

(58) Field of Classification Search ..... 340/870.16, 340/870.17, 539.26, 539.27, 584, 586–599, 340/577, 945, 971, 963, 973; 701/3, 14
See application file for complete search history.

(56) References Cited

U.S. PATENT DOCUMENTS 5,862,030 A * 1/1999 Watkins et al. ..... 361/103
6,246,320 B1 * 6/2001 Monroe ..... 340/506
2005/0140515 A1 * 6/2005 Goodchild ..... 340/584

* cited by examiner

*Primary Examiner*—Jennifer Mehmood
(74) *Attorney, Agent, or Firm*—Rocky Depke & Lyons, LLC

(57) ABSTRACT

A temperature information management system for use in vehicles, particularly commercial airliners. The system provides a sensing section, a converter section, an operations section, an archival section, and a communications section that are all functionally integrated to monitor continuous operating temperatures for an airliner. The system provides a sensing a sensing section for continuously monitoring operating temperatures in designated areas of an airliner. The sensing section generates real-time outputs of information. The system provides a converter section that translates the real-time output information into a digital data format. The system also provides an operations section that has an interface for receiving the digital data and transmits an alert regarding the operating temperatures. An archival section is provided for storing the real-time output information from the sensing section, the digital data from the converter section and the information transmitted from the operations section. The system also provides for a communications section for communicating the information generated, translated, stored and transmitted to systems on-board the airliner, one or more ground aviation control centers, or a combination of both.

16 Claims, 5 Drawing Sheets

Example of Use of Archived Data for On-Line Statistical Control Analysis

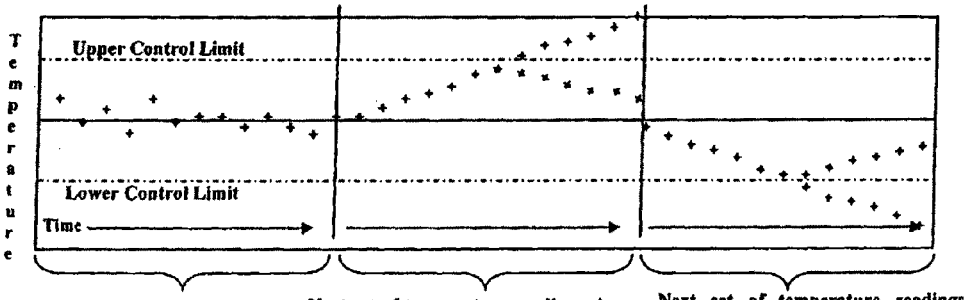

Set of temperature readings show random hovering around center of normal range and normal distribution. Process does not need adjustment.

Next set of temperature readings show successive temperature readings heading upward and beyond upper control limit (red) and out of control without operator intervention. Continued black trace shows result of operator intervention – adjusting the process to keep it within control limits.

Next set of temperature readings show successive temperature readings heading downward and below lower control limit (blue) and out of control without operator intervention. Continued black trace shows result of operator intervention – adjusting the process to keep it within control limits.

Fig. 4

TOTAL TEMPERATURE INFORMATION MANAGEMENT FOR COMMERCIAL AIRLINERS APPARATUS AND METHOD THEREFOR

CROSS-REFERENCE TO RELATED APPLICATIONS

The present application claims priority to and the benefit of U.S. Provisional Application No. 60/854,484, filed on Oct. 26, 2006, and is incorporated by reference and made a part hereof.

FIELD OF THE INVENTION

The present invention relates generally to the field of monitoring environmental and operational conditions on-board vehicles. More specifically, the present invention relates to a system and method for real-time monitoring of temperature conditions on-board commercial aircraft.

BACKGROUND

Commercial vehicles, particularly commercial aircraft, involve a broad range of environmental operating conditions. Operating temperatures of such vehicles, having a multitude of components and systems, are critically important to their safety. It has become of increasing importance to continuously monitor normal operating temperatures in order to readily detect pre-defined abnormal temperature events as they occur. Such monitoring is frequently used to avoid fires or explosions, and/or control damage or loss of such vehicles and personnel utilizing those vehicles.

Protocols for fire detection and extinguishing methods are known, but are limiting in many ways. Currently, the practice on-board many aircraft is to use fixed trip-point, individual point or linear sensors to detect a fire, initiate an alarm or signal, and apply extinguishing methods. Current systems can only detect and respond to fires or smoke, and are not capable of monitoring the earlier abnormal temperature conditions that either caused the fires or represented early warning indicators of conditions that could lead to fires or explosions. There is a need for temperature sensing systems that provide extensive temperature and abnormal temperature location data covering large areas of large commercial aircraft. There is also a need for a comprehensive and intelligent system that provides real-time detection of these abnormal temperature conditions before they result in fires or explosions incurring irreparable damage. There is further a need for a system that establishes archival normative temperature profiles about various systems, equipment, and areas of the aircraft during normative and stable operations. Consequently, any deviation of a particular normal temperature profile, such as a power supply unit, can be characterized as abnormal, real-time alerts issued and communicated to proper personnel, resulting in an orderly procedure to abate a possibly hazardous situation. Finally, there is a need for a system for extensive logging, archiving, data storage and analysis to facilitate personnel on-board the aircraft or on the ground to resolve abnormal temperature situations using archived and real-time information simultaneously. Such a system would vastly exceed the capability and functionality of currently available flight data recorders and sensors currently in use in commercial aviation.

The present invention is provided to solve the problems discussed above and other problems, and to provide advantages and aspects not provided by prior temperature monitoring devices. A full discussion of the features and advantages of the present invention is deferred to the following detailed description, which proceeds with reference to the accompanying drawings.

SUMMARY OF THE INVENTION

The present invention provides for a system designed to monitor continuous operating temperatures for all areas, operating systems and functional components of a large complex vehicle.

According to one aspect of the present invention, a temperature information management system is provided for use in commercial airliners. According to a first aspect of the present invention, the system has a sensing section, a converter section, an operations section, an archival section, and a communications section that are functionally integrated to monitor continuous operating temperatures for an airliner. The sensing section continuously monitors operating temperatures in designated areas of an airliner and generates real-time output information. The converter section translates the real-time output information into a digital data format. The operations section has an interface for receiving the digital data format from the converter section and transmitting an alert regarding the operating temperatures. The archival section is available for storing the real-time output from the converter and the digital data format from the operations section. The communications section communicates the real-time output and archival information on-board the airliner to a ground aviation control center either directly or via satellite, or other vessel such as other aircraft or water vessels.

BRIEF DESCRIPTION OF THE DRAWINGS

To understand the present invention, it will now be described by way of example, with reference to the accompanying drawings in which:

FIG. 4 is an example of archived data of the present invention;

DETAILED DESCRIPTION

Figure 1:
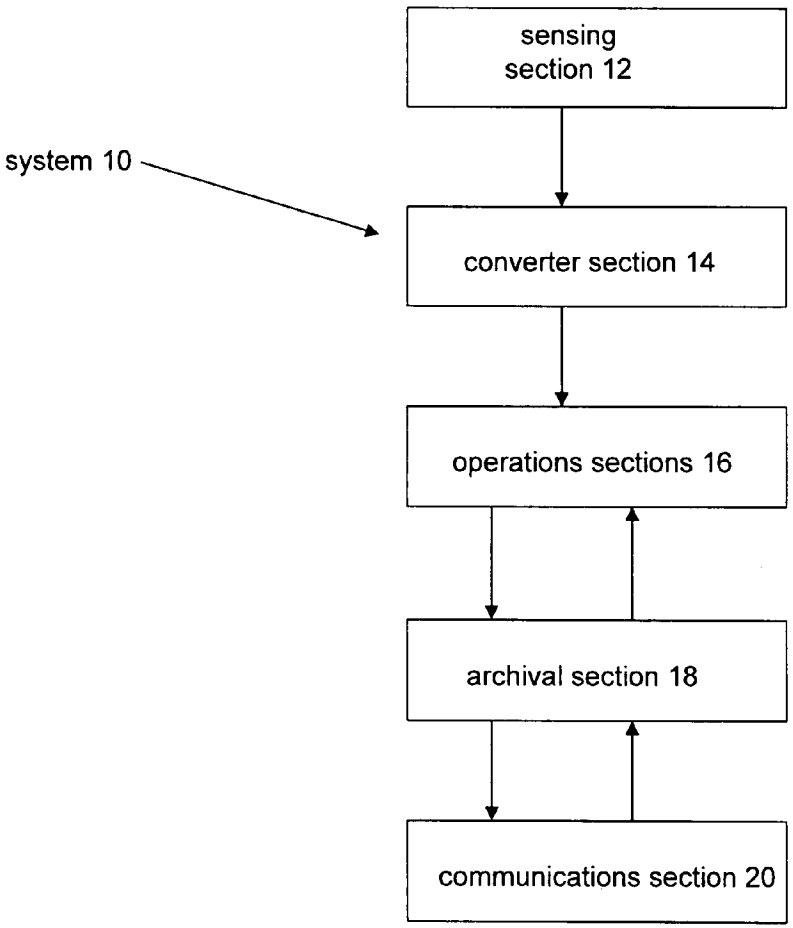
FIG. 1 is a schematic of the present invention.

While this invention is susceptible of embodiments in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

FIG. 1 illustrates the total temperature information management system of the present invention, generally designated with reference numeral 10. The system 10 is designed to monitor continuous operating temperatures for all areas, operating systems and functional components of a large complex vehicle, as well as detection of abnormal conditions and fires. The system 10 also provides a real-time archival management system, which is discussed in greater detail below. In the preferred embodiment, the system 10 is used on-board a commercial aircraft, however the system 10 may be used with complex vehicles including, but not limited to, shipping vessels, trains, submarines, or military vehicles. It is understood that the system 10 is not limited to commercial vehicles, but may have other applications in commercial and residential buildings, hospitals, schools, and non-commercial vehicles.

As shown in FIG. 1, the system 10 has a sensing section 12, a converter section 14, an operations section 16, an archival section 18, and a communications section 20. Each section 12, 14, 16, 18, and 20 of the system 10 is functionally integrated to communicate real-time and archival temperature information relevant to normal and abnormal operations of a commercial aircraft to authorized personnel both on-board the aircraft and on-the ground.

Figure 2:
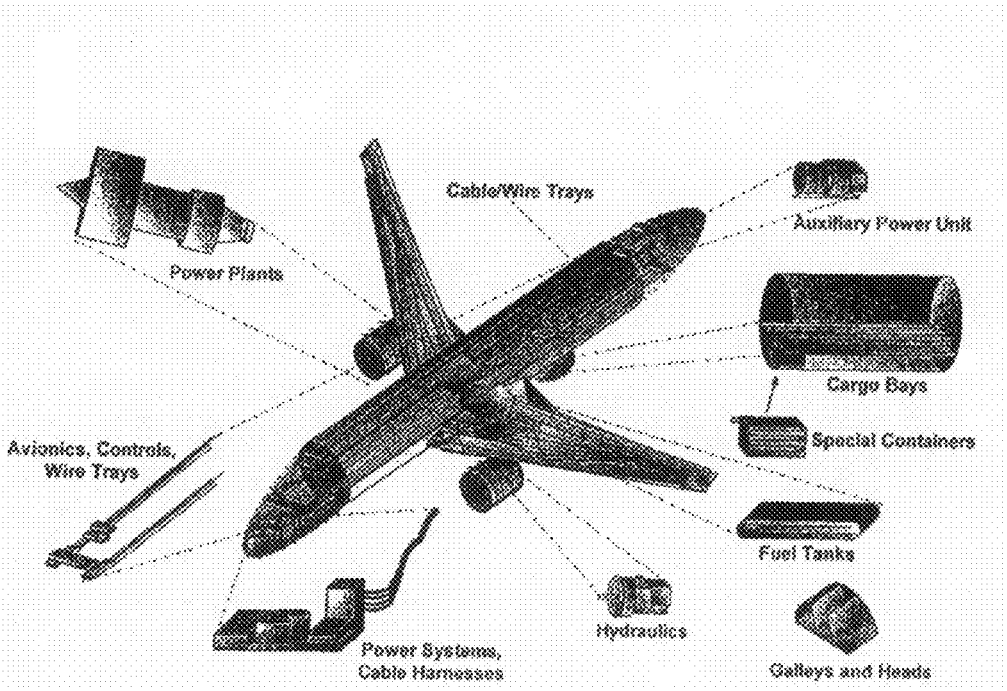
FIG. 2 is a schematic of a commercial aircraft illustrating areas where monitoring of temperature conditions most frequently occurs in accordance with the present invention.
Figure 5C:
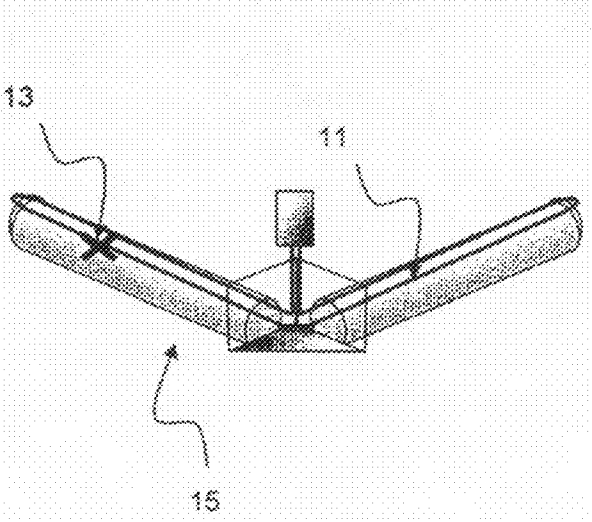
FIG. 5C is a perspective view of a portion of the lineal temperature sensing element of the present invention.
Figure 5B:
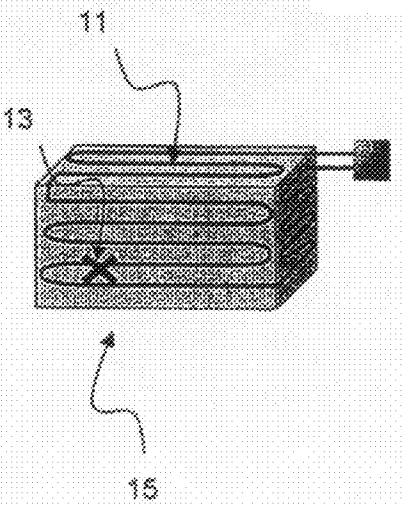
FIG. 5B is a perspective view of a portion of the lineal temperature sensing element of the present invention.
Figure 5A:
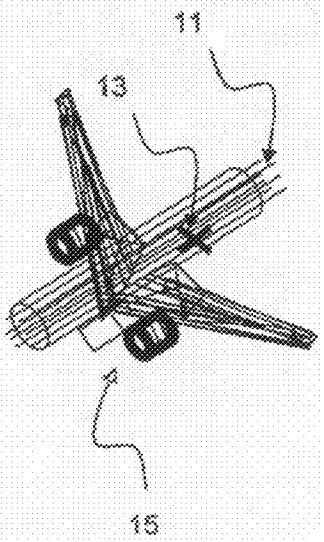
FIG. 5A is a perspective view of a portion of the lineal temperature sensing element of the present invention.

The sensing section 12 continuously monitors the operating temperatures in designated areas of an airliner, and generates a real-time output of information. Sensing sections 12 may be located in any desired area 15 of an aircraft, including but not limited to, power plants, cable/wires trays, auxiliary power units, passenger cabins, cargo bays, special containers, fuel tanks, galleys, heads, hydraulics, power systems, cable harnesses, avionics, cockpits, and controls as shown in FIG. 2. The sensing section 12 comprises either lineal point temperature sensors 22 and/or individual point temperature sensors 24 known in the art. For example, lineal temperature sensors 22 that may be used with the present invention can embody analog outputs 26 and/or fixed temperature outputs 28. Analog output(s) 26 of the present invention may include, but are not limited to voltage, current, resistance, impedance, capacitance, or inductance, optically measured, representing: 1) the highest, lowest, median or average temperature measured anywhere along the lineal sensor length 11 as shown in FIGS. 5*a*-5*c;* 2) the precise location 13 of the temperature readings, in particular the highest temperature measured anywhere along the sensor length 11; and 3) the length, operating capability and current validity of the sensing element. Other temperature sensors may be single-point thermocouples (TCs), resistance temperature detectors (RTDs), thermistors, sealed bulb temperature sensors, and infrared temperature sensors (IR). In one embodiment, the lineal temperature sensor calculates an instantaneous rate-of-change of a temperature excursion, as well as the duration of the latest excursion, where a temperature excursion is defined as departure of a temperature from its normal or current steady value to a new value as the result of an abnormal event such as a piece of equipment suddenly overheating. Fixed temperature discrete outputs 28, may include but are not limited to, contact closure obtained through the melting of an insulator or wax providing notification and location of a temperature event exceeding a predetermined point Point temperature sensors 24 may also be used in connection with the present invention that measure temperatures at a specific point. This is in contrast to lineal temperature sensors that function over a large area or long length. Examples of such analog point temperature sensors include, but are not limited to, thermocouples, resistance temperature detectors (RTDs), thermistors, gas-filled sealed bulb and tube sensors, and infrared sensors (IR). Examples of discrete point temperature sensors include, but are not limited to, temperature switches, electrical, pressure/electrical and mechanical/electrical and solid-state sensors.

As further shown in FIG. 1, the system 10 has a converter section 14. The converter section translates the real-time output information discussed above, in a digital data format. The converter section 14 comprises electronic components, circuits, and/or modules that operate to measure, convert, normalize, scale, amplify, digitize, and retransmit the real-time data in standard analog output formats such as internal device busses, voltage, (such as 0-5 VDC), current (such as 4-20 ma DC analog). Alternatively, digital formats used in commercial aviation such as Ethernet, Modbus, LonWorks, US Bus, optical data highways, and other proprietary formats may be used. Outputs in generally accepted engineering units such as degrees F. temperature, feet length or distance, as defined above are processed from the raw data of voltage, current, resistance, impedance, capacitance, or inductance shown under analog outputs in the converter section 14 of the current invention. In an alternative embodiment, the converter section 14 may also output its information to the other sections of the present invention internally to the system 10.

FIG. 1 also shows the operations section 16 of the system 10. The operations section 16 has a person to machine interface for receiving the digital data described above, and transmitting an alert regarding the operating temperatures. The operations section 16 is functionally capable of receiving real-time and other information from the converter section 14, operator displays, alert and alarm functions, control functions, configuration access, and other visual or audible outputs that serve to keep the designated aircraft personnel advised of the temperature and other information the system 10 is sensing while operating the aircraft. Highly refined and organized real-time graphic displays provide an orderly way for the operator to view, interpret, make decisions, and act using the real-time and archival information to realize the objectives of the system. Such objectives include providing sufficient real-time and archival temperature information about the entire aircraft to intervene in real-time to avert abnormal situations which could lead to fires or explosions with subsequent damage and losses. Another objective is providing sufficient real-time and archival temperature information to later analyze abnormal temperatures events, sequences of events, both averted and un-averted, to discover the root cause, preventing re-occurrence of the event.

The archival section 18 of system 10 is shown in FIG. 1. The archival section 18 stores the real-time output information from the sensing section 12, the digital data from the converter section 14 and the information transmitted form the operations section 16. The archival section 18 performs three primary functions. First, it electronically stores real-time and archival temperature data that may be received from the converter section 14 and the operations section 16. In one embodiment, relevant real-time and archival information may be received either continually or intermittently in packets from other major operating systems on-board the aircraft such as avionics, power-plant, computers, control, weather, power, safety systems, or operator-entered such as information communicated from the ground. Storage in the present system may be accomplished with, but not limited to, hard disk systems, erasable and non-erasable electronic solid-state memory chips and devices, separate computers such as desktop and laptop units, erasable and non-erasable optical diskettes, and magnetic tape and/or disks.

Figure 3:
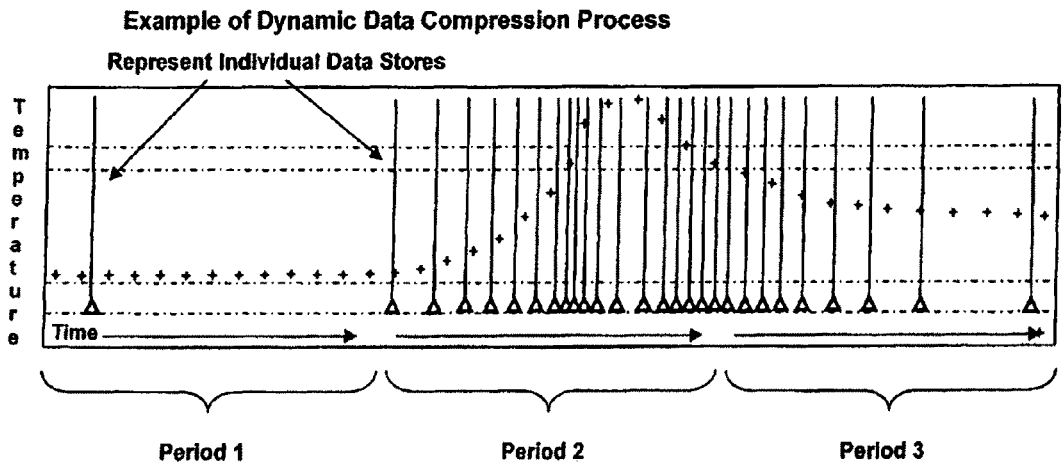
FIG. 3 is an example of a dynamic data compression process of the present invention.

Second, the archival section 18 has active data storage control algorithms that optimize the value and utility of the stored data while minimizing the amount of digital storage space needed to hold the data. Examples of these techniques are timed storage intervals, where data is stored only at predefined intervals; and/or dynamic data compression, either directly or indirectly correlated to the dynamic activity of an individual parameter. For example, if a particular temperature value remains at the same steady state value for long periods of time, it is stored at a pre-defined rate such as one time each minute. However, if the temperature starts to rise rapidly due to an abnormal condition, the storage rate is adaptively increased proportionately to the temperature rate of change such as up to one time each second. FIG. 3 is an example of a dynamic data compression process that determines when and how specific parameters are to be stored. Such parameters may include, but are not limited to, temperature, pressure, flow level, current, speed, voltage and/or humidity.

Third, the archival section 18 operates as a database management instrument, providing comprehensive tools for querying and retrieving, and analyzing the stored archival information. As such, the archival section 18 maintains data storage rates, among other things. Data storage rates for a temperature parameter that normally stays constant over long periods of time can be adaptively tuned to respond rapidly to changing conditions. The database management function may also include necessary functionality to allow authorized third party software to access the data for manipulation to the needs of the software. This could include root cause analysis software programs, statistical analysis programs, statistical process control programs, and other analysis tools that utilize compiled real-time and archival data.

An example is shown in FIG. 3, where the temperature parameter value designated by + is constant throughout Period 1. One data store, designated by ^ is performed on a default basis every five minutes in this example. In Period 2, the variable starts to make a variable rate excursion towards a peak, and then gradually returns to rest at a new level in Period 3. The data storage rate is linearly proportional to the rate-of-change of the process variable during Period 2. Each store contains the Parameter ID Tag Name, Time and Date Stamp, the Parameter Value in engineering Units, Instantaneous Rate-of-Change, and a configurable optional data field associated with the store.

Configuration parameters for data compression functionality may include the following: 1) number of data stores/minute proportional to rate of change of the temperature value—(defined as % full scale change per minute (or second)); lower and upper limits of rate of change causing data stores; 2) limits of minimum and maximum number of data stores per minute according to the proportional rate defined by the proportional rate of change of temperature; 3) default number of data stores per hour (or minute) with rate of change below lower limit of rate of change; and 4) other temperature parameters values in dynamic excursion that can force stores of the cited variable. An example of this would be to increase the rate of temperature value storage and scrutiny for other components in proximity to the original component experiencing the abnormal temperature event. For example, if the temperature of Fuel Tank 2 starts to rapidly increase abnormally, and then the present system will increase the temperature measurement frequency and scrutiny for Fuel Tanks 1 and 3 on either side of Fuel Tank 2.

For units collecting data for a number of variables, the accelerated data collection rate can also force the system to make stores of other related parameters, so upsets involving several different parameters can be carefully analyzed and related for detailed statistical and root-cause correlations. For example, if temperature starts to increase abnormally in a cooling unit, the present invention will start to store and scrutinize other related variables such as coolant pump flow and pressure.

Each store of information contains relevant time and date stamps, parameter identification data, associated point data such as companion temperatures or other linked parameters, alert and alarm information and status, any necessary operator ID information, system status/capability information, priority data, acknowledgement data, and notes about actions taken.

As shown in FIG. 1 of the system 10, a communications section 20 is provided. The communications section 20 functionally and operably communicates between the present invention and all other on-board aviation and control systems. Currently available systems require logging key temperature parameters via an on-board logging device, or "black-box", in contrast the present invention utilizes a multitude of methods to communicate real-time and archived data with on-line data storage, both on-board the aircraft, as well as with any number of data processing centers or aviation control centers, dedicated to this purpose located on the ground. Such communication may take place via proprietary wireless virtual private networks to the ground, via satellite, or the internet.

The present invention provides comprehensive communication of minute-to-minute information about the correct operation of the aircraft and its many subsystems as it flies. Normal operating temperatures, abnormal temperature events and other parameters relevant to equipment malfunction or failure that could result in damage or loss are continuously monitored and evaluated to determine overall status of the aircraft in flight. It is understood that any, all, or part of the main components of the of the present invention, including the sensing section 12, the converter section 14, the operations section 16, the archival section 18, and the communications section 20 may be performed on one or any number of electronic devices, boards, electronic chips and microprocessors, personal computers, or other systems and the functions of each of the sections may well be accomplished by another section or combination of sections.

While the specific embodiments have been illustrated and described, numerous modifications come to mind without significantly departing from the spirit of the invention and the scope of protection is only limited by the scope of the accompanying claims.

What is claimed is:

1. A temperature information management system for use in commercial airliners, the temperature apparatus comprising:

a lineal temperature sensor for continuously monitoring operating temperatures in designated areas of an airliner, the sensor generating a real-time output of information;

a converter section, the converter section translating the real-time output information into a digital data format;

an operations section, the operations section having an interface for receiving the digital data and transmitting an alert regarding the operating temperatures;

an archival section, the archival section storing the real-time output information from the sensor, the digital data from the converter section and the information transmitted from the operations section; and a communications section, the communications section for communicating the information generated, translated, stored and transmitted to systems on-board the airliner, one or more ground aviation control centers, or a combination of both.

2. The system of claim 1, wherein the lineal temperature sensor continuously senses the highest, lowest, or median temperature along the length of the sensor.

3. The system of claim 2, wherein the lineal temperature sensor continuously senses the precise location and temperature value of the highest temperature sensed anywhere along the length of the sensor.

4. The system of claim 1, wherein the lineal temperature sensor calculates an instantaneous rate-of-change of a temperature excursion.

5. The system of claim 1, wherein the lineal temperature sensor has output types comprising analog outputs or fixed temperature discrete outputs.

6. The system of claim 1, wherein the sensing section is a point temperature sensor.

7. The system of claim 1, wherein the sensing section monitors normative operating temperatures.

8. The system of claim 1, wherein the sensing section detects abnormal operating temperatures.

9. The system of claim 1, wherein the designated areas of the airliner comprise power plants, cable/wire trays, auxiliary power units, passenger cabins, cargo bays, special containers, fuel tanks, galleys, heads, hydraulics, power systems, cable harnesses, avionics, or controls.

10. The system of claim 1, wherein the interface of the operations section is between a person and the system.

11. The system of claim 1, wherein the archival section storage comprises hard disk systems, erasable and non-erasable electronic solid-state memory chips and devices, separate computers, erasable and non-erasable optical diskettes, and magnetic tape or disks.

12. The system of claim 1, wherein the archival section comprises an active data storage control algorithms.

13. The system of claim 1, wherein the archival section comprises a database management system.

14. The system of claim 1, wherein the alert identifies parameters relevant to the detection of equipment malfunction.

15. The system of claim 12, wherein the parameters comprise temperature, pressure, flow, level, current, speed, voltage, or humidity.

16. A temperature information management system for use in commercial airliners, the temperature system comprising:

a lineal temperature sensor for continuously monitoring operating temperatures in designated areas of an airliner, the sensor generating a real-time output of information;

a converter section, the converter section translating the real-time output information into a digital data format;

an operations section, the operations section having an interface for receiving the digital data and transmitting an alert regarding the operating temperatures;

an archival section, the archival section storing the real-time output information from the sensor, the digital data from the converter section and the information transmitted from the operations section; and a communications section, the communications section for communicating the information generated, translated, stored and transmitted to systems on-board the airliner, one or more ground aviation control centers, or a combination of both;

wherein when the sensing section receives an abnormal real-time output the operations section transmits the alert to the communications section to disseminate such information to other systems onboard the airliner or to one or more aviation control centers, or a combination of both.

* * * * *